US009758894B2

(12) United States Patent
Bae et al.

(10) Patent No.: US 9,758,894 B2
(45) Date of Patent: Sep. 12, 2017

(54) METAL MATERIAL HAVING PROTECTIVE COATING AND METHOD FOR MANUFACTURING THE SAME

(71) Applicant: Industry-Academic Cooperation Foundation, Yonsei University, Seoul (KR)

(72) Inventors: Dong Hyun Bae, Seoul (KR); Hun Kang, Daejeon (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 292 days.

(21) Appl. No.: 14/613,595

(22) Filed: Feb. 4, 2015

(65) Prior Publication Data

US 2015/0218725 A1 Aug. 6, 2015

(30) Foreign Application Priority Data

Feb. 5, 2014 (KR) ..... 10-2014-0012925

(51) Int. Cl.

| | |
|---|---|
| ***C25D 11/30*** | (2006.01) |
| ***B22D 19/14*** | (2006.01) |
| ***B22D 1/00*** | (2006.01) |
| ***C25D 11/02*** | (2006.01) |
| ***C25D 11/04*** | (2006.01) |

(52) U.S. Cl.

CPC ..... *C25D 11/30* (2013.01); *B22D 1/00* (2013.01); *C25D 11/026* (2013.01); *C25D 11/04* (2013.01)

(58) Field of Classification Search

CPC ..... B22D 1/00

See application file for complete search history.

(56) References Cited

U.S. PATENT DOCUMENTS

| | | | | |
|---|---|---|---|---|
| 5,811,194 | A * | 9/1998 | Kurze | C25D 11/026 428/469 |
| 2014/0127069 | A1* | 5/2014 | Bae | C22C 1/1036 419/19 |
| 2014/0186207 | A1* | 7/2014 | Bae | C22C 23/02 420/402 |

FOREIGN PATENT DOCUMENTS

| | | |
|---|---|---|
| KR | 10-2008-66580 | 7/2008 |
| KR | 10-1341352 | 1/2013 |

* cited by examiner

*Primary Examiner* — Kishor Mayekar

(57) ABSTRACT

A method of manufacturing a metal material is provided. The method includes steps of manufacturing a metal material in which oxygen atoms are dispersed, and forming a protective coating on a surface of the metal material by using an anode oxidation treatment, wherein the oxygen atoms in the metal material are supplied to the surface of the metal material during the anode oxidation treatment, so that the metal material and the protective coating are interface-bonded to each other substantially without pores therebetween or without an interface layer in which pores are formed, thereby improving corrosion resistance, as compared to a protective coating formed on a surface of a metal material in which oxygen atoms are not dispersed.

13 Claims, 7 Drawing Sheets

METAL MATERIAL HAVING PROTECTIVE COATING AND METHOD FOR MANUFACTURING THE SAME

CROSS REFERENCE TO RELATED APPLICATION

The present application claims priority from Korean Patent Application Number 10-2014-0012925 filed on Feb. 5, 2014, the entire contents of which are incorporated herein for all purposes by this reference.

BACKGROUND OF THE INVENTION

Field of the Invention

The present invention relates to a metal material having a protective coating formed thereon and a method for manufacturing the same, and more particularly, to a metal material having a protective coating formed thereon in which an interface characteristic between the protective coating and a matrix (substrate) metal is improved and a method for manufacturing the same.

Description of Related Art

Mg is an environmental friendly material that has a density of 1.74 g/cm$^3$ which is merely ⅕ of Fe and ⅔ of Al, generally has superior strength and can be easily recycled. Mg is also evaluated as an ultra-lightweight structural material, and has the specific strength and elastic coefficient of which are comparable to those of other lightweight materials, such as Al. In addition, Mg exhibits a superior ability to absorb vibration, impact, electromagnetic wave and the like, and has superior electrical and thermal conductivities.

However, Mg and Mg alloys have the fundamental problem of poor corrosion resistance despite of the above-mentioned excellent characteristics. Since it is known that Mg rapidly corrodes under electromotive force (EMF) and in a galvanic reaction due to its high reactivity, the use of Mg is limited to internal parts in which corrosion environment conditions are not strict or regions in which strength, thermal resistance and corrosion resistance are not highly required. Therefore, although a technology for fundamentally improving the corrosion resistance of Mg and Mg alloys is still required, this requirement is not satisfied by present technologies.

In the meantime, it has been known a method of forming a coating on a surface of a material so as to improve the corrosion resistance. For example, Korean Patent Application Publication No. 10-2008-66580A discloses a surface treatment method of an aluminum alloy. A coating layer is formed through processes of removing an aluminum oxide film, forming a nickel-plated film, forming an electroless copper plated film, and the like, so that an aluminum matrix is protected.

The information disclosed in the Background of the Invention section is provided only for enhancement of (or better) understanding of the background of the invention, and should not be taken as an acknowledgment or any form of suggestion that this information forms a prior art that would already be known to a person skilled in the art.

BRIEF SUMMARY OF THE INVENTION

Various aspects of the present invention provide a metal material having a protective coating capable of improving an interface characteristic between the protective film and a metal matrix, for example, an interface bonding, and a method for manufacturing the same.

Also provided are a metal material having a protective coating of which an interface characteristic is improved by using an anode oxidation method, which is simpler and has a superior industrial applicability, as compared to a general plating oxidation method, and a method for manufacturing the method.

Also provided are a metal material (for example, magnesium material) having improved corrosion resistance thereof with a protective coating formed thereon, and a method for manufacturing the same.

In an aspect of the present invention, provided is a method of manufacturing a metal material. The method includes steps of manufacturing a metal material in which oxygen atoms are dispersed, and forming a protective coating on a surface of the metal material by using an anode oxidation treatment, wherein the oxygen atoms in the metal material are supplied to the surface of the metal material during the anode oxidation treatment, so that the metal material and the protective coating are interface-bonded to each other substantially without pores therebetween or without an interface layer in which pores are formed, thereby improving corrosion resistance, as compared to a protective coating formed on a surface of a metal material in which oxygen atoms are not dispersed.

According to an embodiment of the present invention, the metal material in which the oxygen atoms are dispersed may be manufactured by a casting method.

According to an embodiment of the present invention, the casting method may include steps of preparing a molten metal of the metal material, and inputting oxide particles into the molten metal to manufacture a cast material in which the oxygen atoms decomposed from the oxide particles are dispersed.

According to an embodiment of the present invention, a plasma electrolytic oxidation treatment may be adopted as the anode oxidation treatment.

According to an embodiment of the present invention, the metal material may be magnesium, magnesium alloy, aluminum or aluminum alloy.

In an aspect of the present invention, provided is a metal material having a protective coating formed thereon in which oxygen atoms are dispersed in the metal material and pores are not substantially formed between the metal material and the protective coating or an interface layer, in which pores are formed, is not formed therebetween.

According to an embodiment of the present invention, the protective coating may be formed on a surface of the metal material by using an anode oxidation treatment.

According to an embodiment of the present invention, a plasma electrolytic oxidation treatment may be adopted as the anode oxidation treatment.

According to an embodiment of the present invention, during the anode oxidation treatment, the oxygen atoms of the metal material may be supplied to the surface of the metal material, so that the protective coating is thus substantially uniformly formed along the surface of the metal material.

In an aspect of the present invention, provided is a method of manufacturing a metal material having a protective coating formed thereon. The method includes steps of preparing a molten metal of the metal material, inputting oxide particles into the molten metal to manufacture a cast material in which the oxygen atoms decomposed from the oxide particles are dispersed, and performing an anode oxidation treatment for the cast material having the oxygen atoms dispersed therein to thus form a protective coating thereon, wherein the oxygen atoms in the cast material are supplied to a surface of the cast material during the anode oxidation treatment, so that the protective coating is substantially uniformly formed along the surface of the cast material and pores are not substantially formed between the surface of the cast material and the protective coating or an interface layer, in which pores are formed, is not substantially formed therebetween.

As set forth above, as compared to a general metal material having a protective coating formed thereon of the related art, according to the present invention, it is possible to provide a metal material having a protective coating formed thereon having improved the corrosion resistance and the interface characteristic between the matrix metal and the protective coating.

The materials and methods of the present invention have other features and advantages which will be apparent from, or are set forth in greater detail in the accompanying drawings, which are incorporated herein, and in the following Detailed Description of the Invention, which together serve to explain certain principles of the present invention.

DETAILED DESCRIPTION OF THE INVENTION

Reference will now be made in detail to exemplary embodiments of the present invention in conjunction with the accompanying drawings. Herein, detailed descriptions of some technical constructions or terms well known in the art will be omitted. Even if such descriptions are omitted, the features of the present invention will be apparent to a person skilled in the art from the following description.

First, an illustrative embodiment of preparing a metal material before forming a protective coating is described.

The inventors manufactured a cast material in which oxygen atoms are dispersed in a matrix metal by using a general casting method. Specifically, in a method of manufacturing a magnesium material according to an illustrative embodiment of the present invention, magnesium and aluminum were melted (AZ91 magnesium alloy) using an electric melting furnace, and then titania powders ($TiO_2$, 50 nm) were input into the molten metal and stirred by a stirring means. At this time, titania was mixed by a volume ratio of 3% with respect to magnesium/aluminum. Also, protective gas ($SF_6$+$CO_2$) was used throughout the manufacturing process in order to prevent oxidation. Meanwhile, although the magnesium alloy was used in this illustrative embodiment, pure magnesium may also be used, which is also included within the scope of the present invention. In the cast material manufactured according to the above process, oxygen atoms are dispersed. That is, the oxygen atoms originating from titania are dispersed in the matrix. In the meantime, an example of the technology of dispersing oxygen atoms in a metal material is disclosed in Korean Patent No. 1,341,352B, which is incorporated herein for all purposes by this reference.

Figure 1:
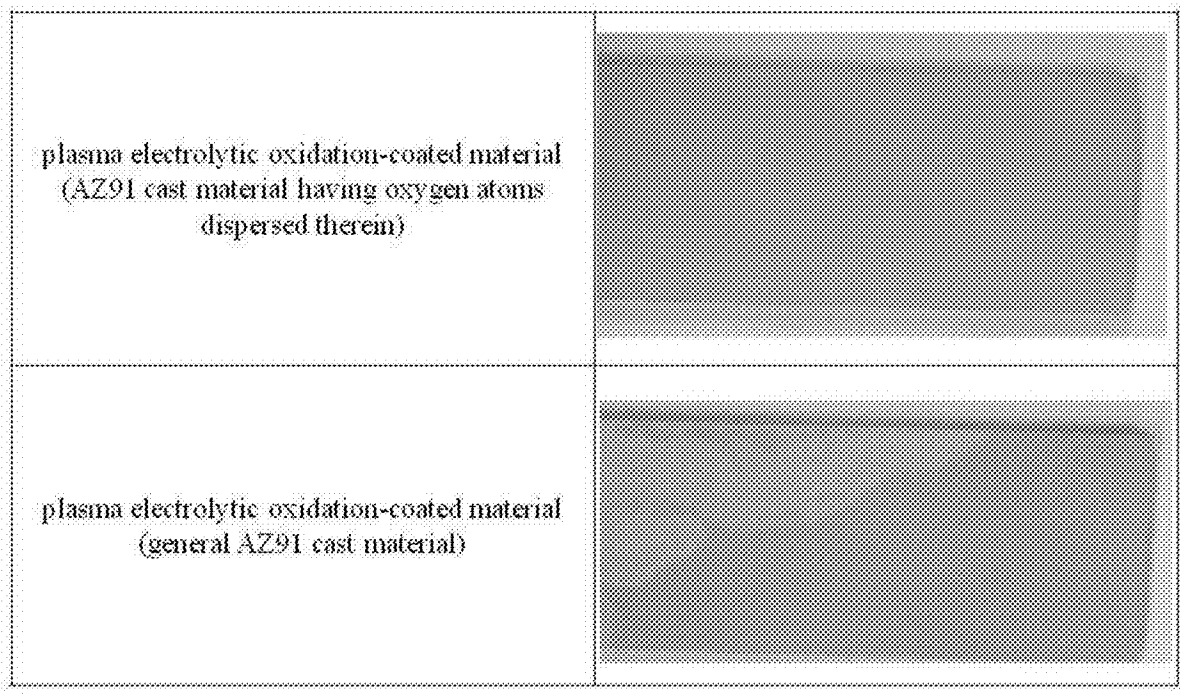
FIG. 1 is photographs showing a plasma electrolytic oxidation-coated cast material manufactured according to an illustrative embodiment of the present invention in which oxygen atoms are present in an AZ91 matrix, and a general plasma electrolytic oxidation-coated AZ91 magnesium material.

The inventors formed a coating layer on the cast material having the oxygen atoms dispersed therein by using an anode oxidation treatment, not a general plating method. As a result, the inventors achieved an extraordinary result. Specifically, the inventors formed an oxide film of $MgO_x$ on a surface of the AZ91 magnesium cast material having oxygen atoms dispersed therein by performing a plasma electrolytic oxidation method, which is one of the anode oxidation method. At this time, a solution consisting of distilled water 1 L, potassium fluoride (KF) 0.05 mol, potassium hydroxide (KOH) 0.09 mol and pyrophosphoric acid potassium ($K_4P_2O_7$) 0.01 mol was used. The material was immersed in the solution, which was then applied with a voltage of 400V and current of 1 A for 5 minutes. A surface state of a sample manufactured by the above method is shown in FIG. 1. A surface of a general AZ91 magnesium cast material (i.e., a cast material in which oxygen atoms are not dispersed) coated by a plasma electrolytic oxidation method exhibits an uneven sense of color due to the non-uniform growth of the coating layer (the lower photograph). In contrast, the ZA91 magnesium cast material in which oxygen atoms are dispersed exhibits the same color as a whole (the upper photograph). That is, it can be seen that the growth of the coating layer is uniform.

Figure 2:
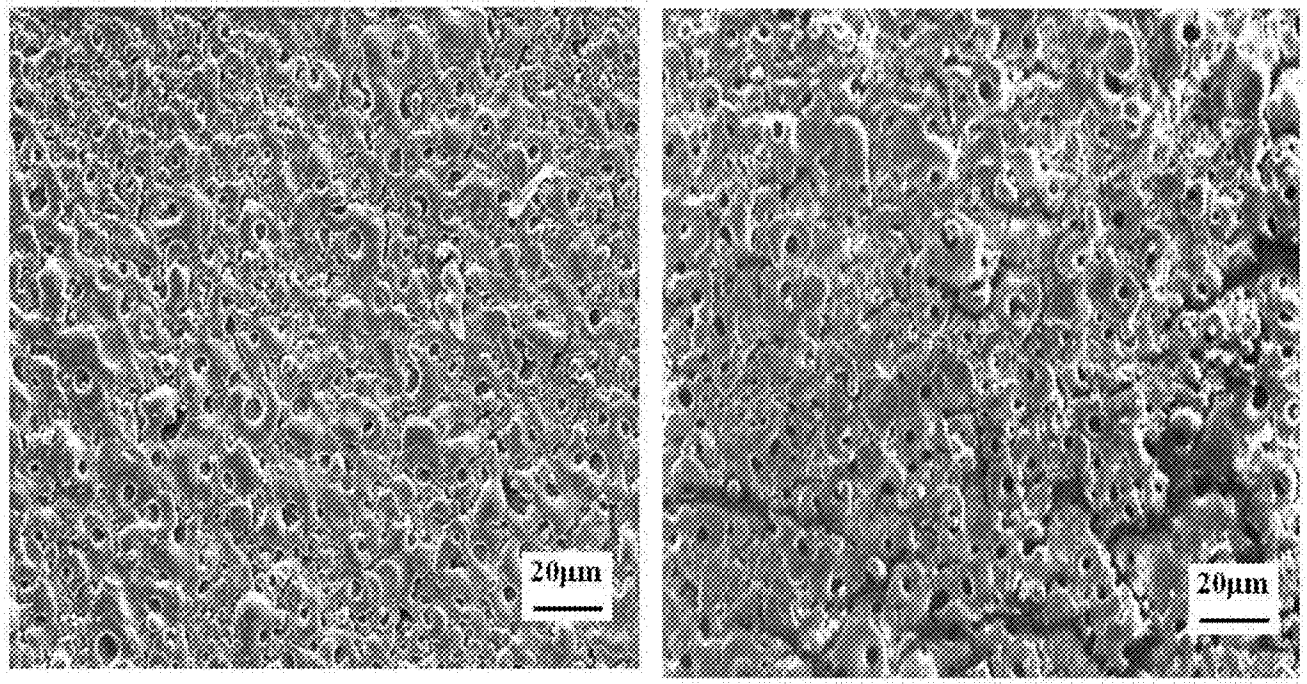
FIG. 2 is SEM (scanning electron microscope) photographs showing a surface of a protective coating of the AZ91 cast material in which oxygen atoms are dispersed according to an illustrative embodiment of the present invention and a surface of a protective coating of the general AZ91 cast material.
Figure 3:
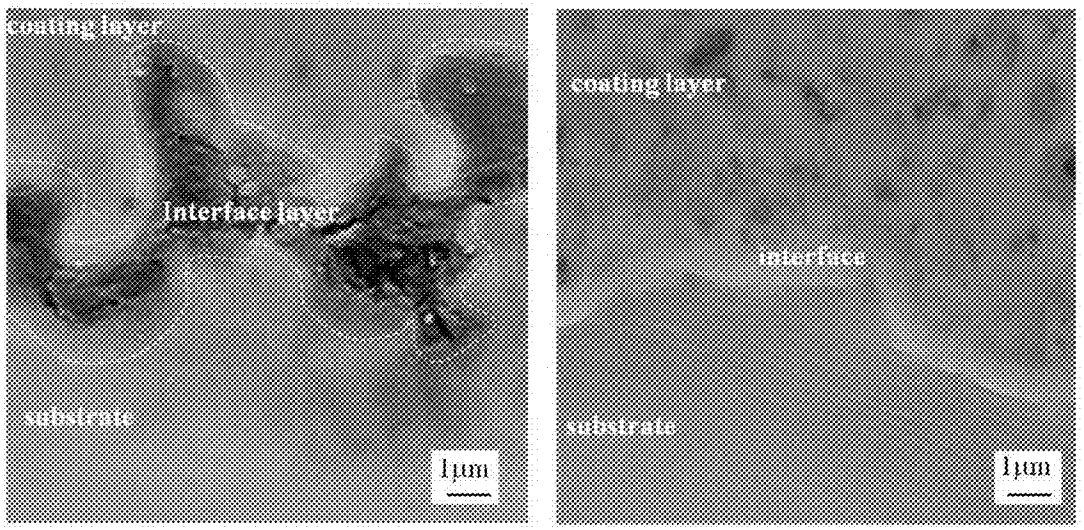
FIG. 3 is SEM photographs showing an interface formed after performing a plasma electrolytic oxidation coating on the general AZ91 cast material (left) and an interface formed after performing a plasma electrolytic oxidation coating on the AZ91 cast material in which oxygen atoms are dispersed (right) according to an illustrative embodiment of the present invention.

In order to analyze a micro structure of the protective coating of the magnesium material manufactured as described above, the magnesium material was observed by a scanning electron microscope (SEM). The results are shown in FIGS. 2 and 3. FIG. 2 shows a surface of the magnesium cast material having oxygen atoms dispersed therein according to an illustrative embodiment of the present invention and a surface of a general cast material. From the photographs, it can be seen that pores formed on the surface and cracks due to non-uniform growth of the coating layer are relatively smaller in the cast material having the oxygen atoms dispersed therein (left) than the general cast material (right). This implies that the pores and the crack are generated at many places of the general cast material because it is not possible to uniformly match coating layer growth speeds of a magnesium matrix and a eutectic phase only with the oxygen transferred from the solution. However, according to the cast material having oxygen atoms dispersed therein, it seems that a potential difference between the magnesium matrix and the eutectic phase is lowered due to the dispersed oxygen atoms and the coating layer speeds are thus uniform and that the oxygen atoms are supplied from the magnesium matrix and the coating layer having a higher density is thus formed. The phenomena are shown in FIG. 3.

As shown in FIG. 3, an interface layer is formed between the matrix and the protective coating formed on the general cast material. In the interface layer, many pores are formed. As a result, it seems that the corrosion resistance is deteriorated. However, according to the cast material having oxygen atoms dispersed therein of the illustrative embodiment of the present invention, it can be seen that the protective coating and the matrix metal form a strong interface boding with being very closely contacted and pores are hardly formed. As a result, it seems that the corrosion resistance is improved. The strong interface bonding between the protective coating and the matrix metal is a novel boding that has not been reported up to now.

Figure 4:
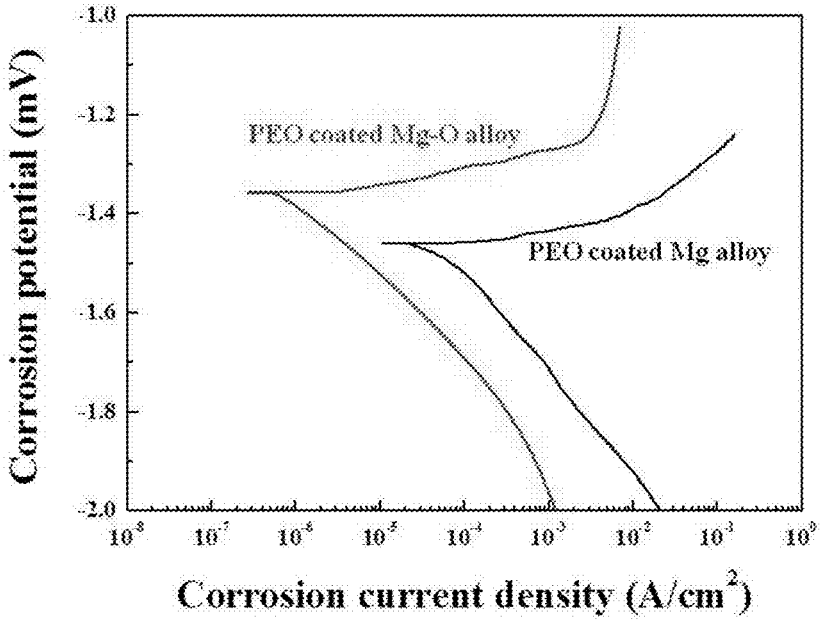
FIG. 4 is a Tefal graph showing that corrosion resistance of a magnesium alloy material having a protective coating manufactured according to an illustrative embodiment of the present invention is improved.

Specifically, the inventors carried out a corrosion test in a solution consisting of distilled water 1 L and NaCl 0.1 mol, so as to check whether the function of the protective coating formed on the surface of the magnesium material through the above-described oxidation coating is improved. A result is shown in FIG. 4. As can be seen from the result of FIG. 4, the corrosion rate was made to be slower by 100 times or higher (i.e., the corrosion characteristic was improved), through the strong interface bonding between the protective coating and the magnesium matrix. That is, the protective coating is strongly interface-bonded with the matrix metal and the pores are little formed therebetween, in contrast to the related art, so that the corrosion resistance seems to be resultantly improved.

Figure 5:
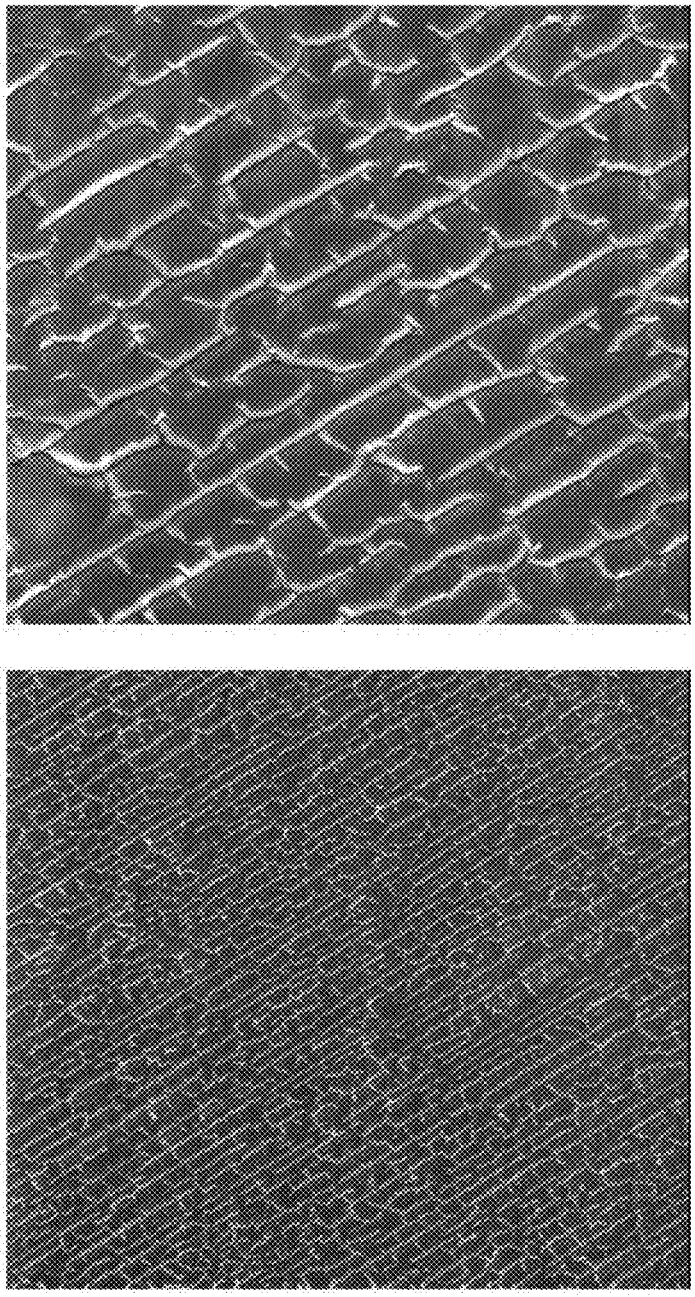
FIG. 5 is SEM photographs showing a surface of an aluminum cast material in which oxygen atoms are present, manufactured according to an illustrative embodiment of the present invention, after performing an anode oxidation treatment.
Figure 6:
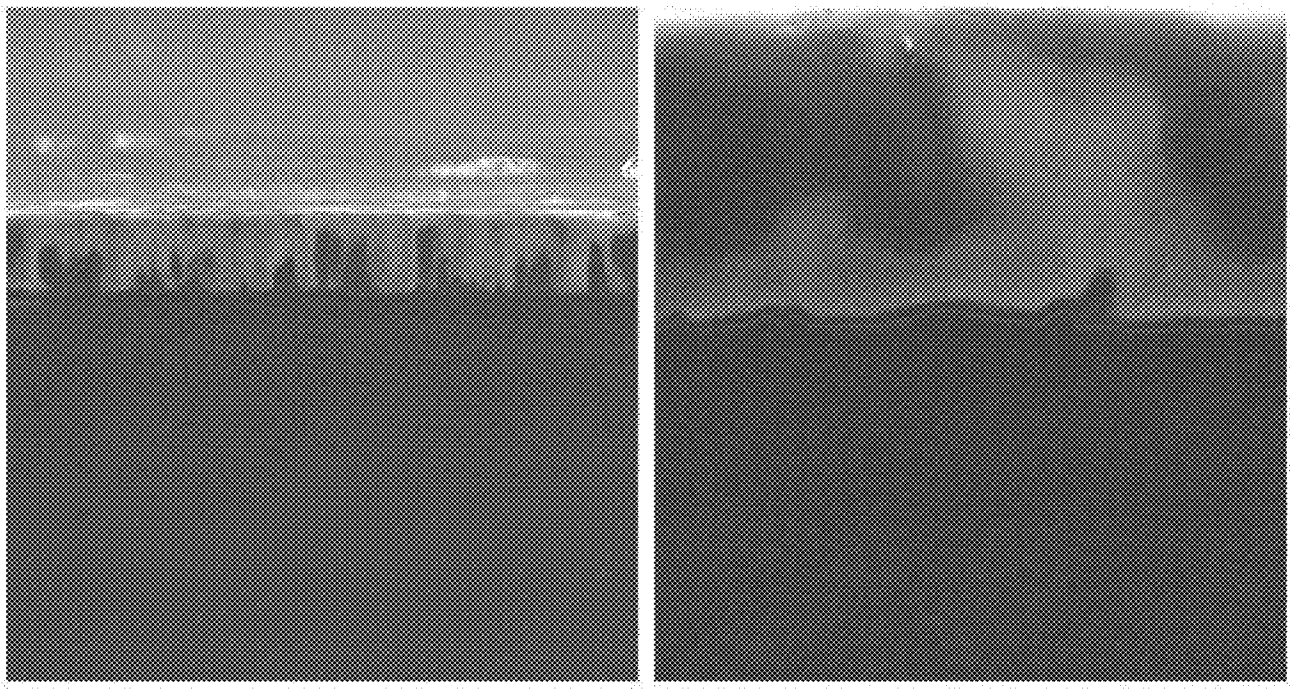
FIG. 6 is SEM photographs showing a surface of an aluminum cast material having a protective coating manufactured according to an illustrative embodiment of the present invention, after performing an anode oxidation treatment.
Figure 7:
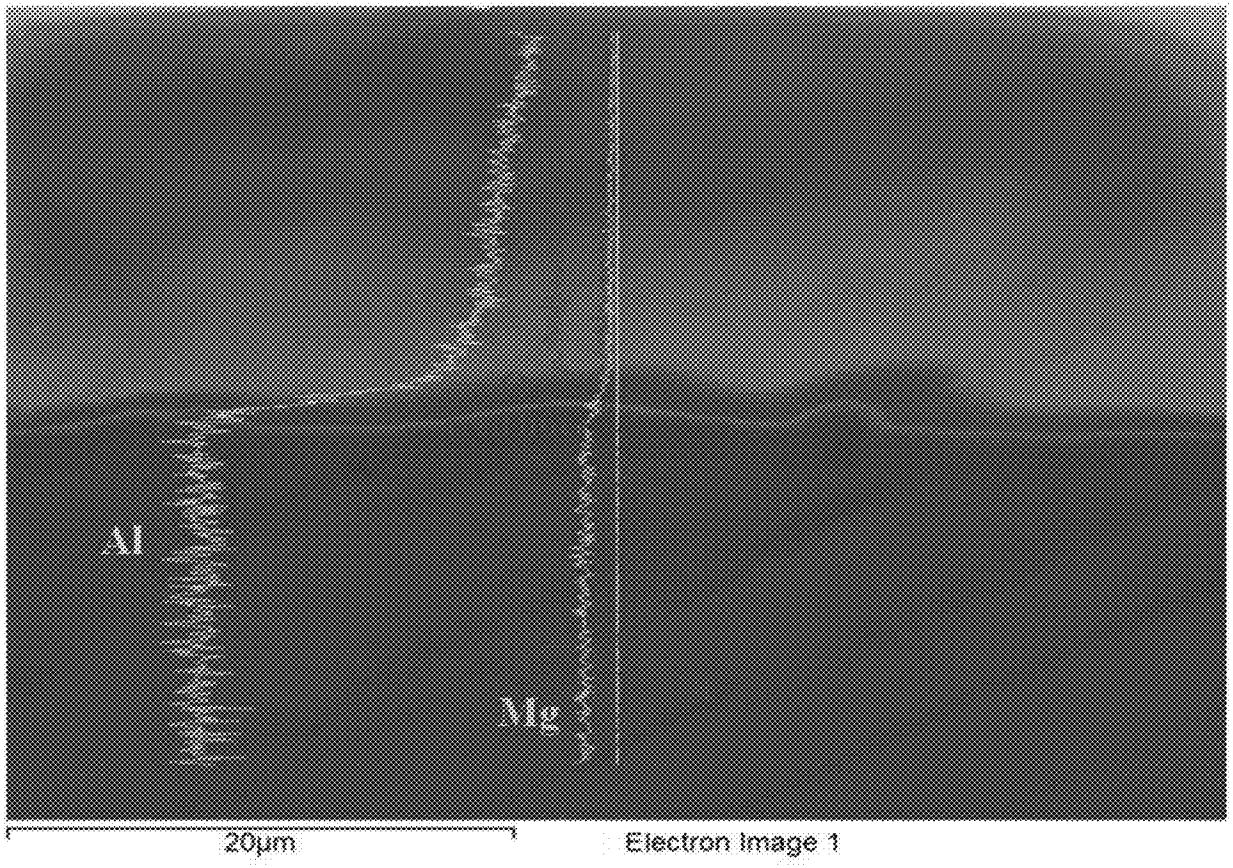
FIG. 7 is a photograph showing an EDS analysis result of the aluminum cast material having a protective coating manufactured according to an illustrative embodiment of the present invention.

Also, the inventors performed the same processes for an aluminum alloy, in addition to the magnesium alloy. That is, magnesium 5% (by mass ratio) was added to pure aluminum and titania was decomposed, so that a cast material having oxygen atoms dispersed therein was manufactured, in the same manner as the above. Then, an aluminum alloy having a uniform protective coating layer formed thereon by using a general aluminum anode oxidation method was manufactured. Specifically, the cast material was immersed in a solution in which sulfuric acid ($H_2SO_4$) of 13% was added to distilled water 1 L. Then, the solution was applied with a voltage of 15V and current of 0.5 A, so that an aluminum material having a protective coating formed thereon was manufactured. A surface state of the material manufactured by the above method was observed by the SEM and a result thereof is shown in FIG. 5. The left photograph of FIG. 5 shows a surface of the aluminum cast material subject to the anode oxidation treatment. It can be seen that pores are not formed and the protective coating is uniformly formed. The surface of the protective coating was observed with a higher magnification so as to check whether the pores are formed. A result thereof is shown at the right of FIG. 5. Also, a section of the aluminum material was photographed and is shown in FIG. 6. Like the magnesium material, it can be seen that the protective coating and the metal matrix form a strong interface bonding substantially without pores (i.e., an interface layer in which pores are formed is not substantially formed) in the aluminum material. That is, it can be seen that the interface characteristic is improved in the aluminum cast material having oxygen atoms dispersed therein, too. In order to analyze components forming the interface, the components were analyzed through an EDS of the SEM, and a result is shown in FIG. 7. As can be seen from FIG. 7, the strong bonding is formed through an appropriate atom arrangement of aluminum and oxygen atoms. That is, it can be seen from an EDS line scanning (red line) that the pores are not formed between the matrix metal and the protective coating and a concentration of oxygen at the interface is increased.

Although the present invention has been described in relation to the certain exemplary embodiments, it should be understood that the present invention is not limited thereto. The foregoing embodiments can be made into various alterations and modifications without departing from the scope of the appended Claims, and all such alterations and modifications fall within the scope of the present invention. For example, the magnesium and aluminum alloy have been exemplified in the illustrative embodiment. However, it should be noted that any metal material in which oxygen atoms are dispersed can supply the oxygen atoms upon the anode oxidation to enable the protective coating to substantially uniformly grow and to form the strong interface between the matrix metal and the protective coating. Also, titania have been used to disperse the oxygen atoms. However, a variety of nano-particles such as alumina ($Al_2O_3$), silica ($SiO_2$), zinc oxide ($ZnO_2$), zirconia ($ZrO_2$), tin oxide ($SnO_2$) and the like may also be used. That is, the oxide particles capable of supplying the oxygen atoms are not particularly limited inasmuch as the particles can supply the oxygen atoms to be dispersed in the metal matrix. Also, the protective coating has been formed on the cast material. However, it is not necessarily required to manufacture the metal material having the oxygen atoms dispersed therein by the casting method. Like this, the present invention can be diversely modified and changed, which are all included within the scope of the present invention. Therefore, the present invention shall be defined by only the claims and their equivalents.

The invention claimed is:

1. A method of manufacturing a metal material, the method comprising steps of:

manufacturing a metal material in which oxygen atoms are dispersed; and forming a protective coating on a surface of the metal material by using an anode oxidation treatment, the oxygen atoms in the metal material being supplied to the surface of the metal material during the anode oxidation treatment, so that the metal material and the protective coating are interface-bonded to each other substantially without pores therebetween or without an interface layer in which pores are formed, thereby improving corrosion resistance, as compared to a protective coating formed on a surface of a metal material in which the oxygen atoms are not dispersed.

2. The method according to claim 1, wherein during the anode oxidation treatment, the oxygen atoms of the metal material are supplied to the surface of the metal material, so that the protective coating is substantially uniformly formed along the surface of the metal material substantially without pores therebetween or without the interface layer in which pores are formed.

3. The method according to claim 1, wherein the metal material in which the oxygen atoms are dispersed is manufactured by a casting method.

4. The method according to claim 3, wherein the casting method comprises steps of preparing a molten metal of the metal material, and inputting oxide particles into the molten metal to manufacture a cast material in which the oxygen atoms decomposed from the oxide particles are dispersed.

5. The method according to claim 1, wherein a plasma electrolyte oxidation treatment is adopted as the anode oxidation treatment.

6. The method according to claim 1, wherein the metal material is magnesium, magnesium alloy, aluminum or aluminum alloy.

7. A method of manufacturing a metal material having a protective coating formed thereon, the method comprising steps of:

preparing a molten metal of the metal material;

inputting oxide particles into the molten metal to manufacture a cast material in which oxygen atoms decomposed from the oxygen particles are dispersed; and performing an anode oxidation treatment for the cast material having the oxygen atoms dispersed therein to form a protective coating thereon, the oxygen atoms in the cast material being supplied to a surface of the cast material during the anode oxidation treatment, so that the protective coating is substantially uniformly formed along the surface of the cast material and pores are not substantially formed between the surface of the cast material and the protective coating or an interface layer, in which pores are formed, is not substantially formed therebetween.

8. The method according to claim 7, wherein a plasma electrolyte oxidation treatment is adopted as the anode oxidation treatment.

9. The method according to claim 8, wherein the metal material is magnesium, magnesium alloy, aluminum or aluminum alloy.

10. A method of manufacturing a metal material, the method comprising steps of:

manufacturing a metal material in which oxygen atoms are dispersed by a casting method, the casting method comprises:

preparing a molten metal of the metal material; and inputting oxide particles into the molten metal to manufacture a cast material in which the oxygen atoms decomposed from the oxide particles are dispersed; and forming a protective coating on a surface of the metal material by using an anode oxidation treatment.

11. The method according to claim 10, wherein during the anode oxidation treatment, the oxygen atoms of the metal material are supplied to the surface of the metal material, so that the protective coating is substantially uniformly formed along the surface of the metal material substantially without pores therebetween or without an interface layer in which pores are formed.

12. The method according to claim 10, wherein a plasma electrolyte oxidation treatment is adopted as the anode oxidation treatment.

13. The method according to claim 10, wherein the metal material is magnesium, magnesium alloy, aluminum or aluminum alloy.

* * * * *